US006553719B1

(12) United States Patent
Stone et al.

(10) Patent No.: US 6,553,719 B1
(45) Date of Patent: Apr. 29, 2003

(54) DOOR MOUNTED POWER SLIDING DOOR MECHANISM

(75) Inventors: Bruce Stone, Waterford, MI (US); Michael Turk, Waterford, MI (US); Jeffrey Kolar, Livonia, MI (US); Jose Garcia, Troy, MI (US); Dennis Reid, Rochester, MI (US)

(73) Assignee: Hi-Lex Corporation, Battle Creek, MI (US)

( * ) Notice: Subject to any disclaimer, the term of this patent is extended or adjusted under 35 U.S.C. 154(b) by 0 days.

(21) Appl. No.: 09/687,751

(22) Filed: Oct. 13, 2000

(51) Int. Cl.[7] ..... E05F 11/54
(52) U.S. Cl. ..... 49/358; 49/360; 49/352
(58) Field of Search ..... 49/360, 352, 348, 49/349, 358

(56) References Cited

U.S. PATENT DOCUMENTS

| | | | | |
|---|---|---|---|---|
| 4,612,729 A | | 9/1986 | Sato | |
| 4,887,390 A | * | 12/1989 | Boyko et al. | 49/214 |
| 5,046,283 A | | 9/1991 | Compeau et al. | |
| 5,323,570 A | | 6/1994 | Kuhlman et al. | |
| 5,606,826 A | * | 3/1997 | Calhoun | 49/138 |
| 5,813,282 A | | 9/1998 | Azuma | |
| RE36,428 E | | 12/1999 | Moore et al. | |
| 6,009,671 A | | 1/2000 | Sasaki et al. | |
| 6,079,767 A | * | 6/2000 | Faubert et al. | 296/155 |
| 6,125,583 A | * | 10/2000 | Murray et al. | 49/362 |
| 6,174,020 B1 | * | 1/2001 | Knettle et al. | 296/155 |
| 6,256,930 B1 | * | 7/2001 | Faubert et al. | 49/362 |
| 6,276,743 B1 | * | 8/2001 | Jyawook et al. | 296/155 |
| 6,321,488 B1 | * | 11/2001 | Bigoszewski et al. | 49/358 |
| 6,430,873 B1 | * | 8/2002 | Borchuk et al. | 49/352 |

FOREIGN PATENT DOCUMENTS

JP Hei 1 18217 11/1991

* cited by examiner

*Primary Examiner*—Gregory J. Strimbu
(74) *Attorney, Agent, or Firm*—Young & Basile P.C.

(57) ABSTRACT

A motorized sliding door mechanism for a motor vehicle having a body structure having a door opening and door. The mechanism includes a motor and drum assembly mounted on the door and a cable system including cable runs anchored to spaced points on the body structure. One cable run is wrapped in one direction around the drum and extends to an anchor point proximate the rear edge of the door opening of the body structure and a second run is wrapped around the drum in an opposite direction and extends to a point at the rear end of a rear guide track for the door which is mounted to the body structure. The cable runs extend from the drum to the anchor points via a pivotal hinge and a guide block at the rear of the door for guiding the sliding movement of the door.

14 Claims, 5 Drawing Sheets

DOOR MOUNTED POWER SLIDING DOOR MECHANISM

BACKGROUND OF THE INVENTION

This invention relates to sliding door assemblies for motor vehicles and more particularly to motorized sliding door assemblies.

In automotive vehicles of the passenger delivery van type, it has become common practice to provide the vehicle body with a relatively large side opening that is located immediately behind the passenger side front door and/or behind the driver side front door and is opened and closed with a sliding door. The sliding door is typically mounted with hinges on horizontal tracks on the vehicle body for guided sliding movement between a closed position flush with the vehicle body closing the side opening and an open position located outward of and along side the vehicle body rearward of the side opening. The sliding door may be opened manually or with a power operated system. Whereas numerous power operated systems have been proposed and utilized for opening and closing the sliding door, all of the known power systems suffer from one or more disadvantages. Specifically, either the bulk of the power mechanism is mounted in the rear quarter panel area of the vehicle body structure with the result that interior space in the rear quarter panel area is largely consumed and/or the power system is exposed such that it is extremely vulnerable to dirt and other environmental problems and/or, if the motor mechanism is mounted in the door, the system is such that bending moments are created in the door during the opening and closing movement that may result in binding or excessive wear.

SUMMARY OF THE INVENTION

The invention relates to a power sliding door assembly for use with a motor vehicle having a body structure defining a door opening, the sliding door assembly comprising a sliding door including means mounting the door on the body structure for movement between a closed position positioned within the opening and an open position removed from the opening.

According to the invention, an electric motor assembly is mounted on the door and includes a drum driven by the motor, and a cable system driven by the drum includes cable runs adapted to be anchored to spaced points on the body structure. The cable system is operative in response to energization of the motor to move the door assembly between open and closed positions. This arrangement frees up the area in the quarter panel behind the door opening for accessory items and yet provides a simple and effective means of opening and closing the door.

According to a further feature of the invention, the door mounting means includes a guide hinge attached to the door and adapted to guide in a guide track in the body structure to guide the opening and closing movement of the door and the cable system includes a cable guide structure supported on the guide hinge and guiding the cable runs. This arrangement, whereby an existing guide hinge of the door structure is utilized to route the cables between the motor assembly and the body structure, simplifies the manufacturing and installation of the motorized system and provides an effective opening and closing movement.

According to a further feature of the invention, the guide track extends rearwardly along the body structure from the rear edge of the door opening and the guide hinge is pivotally attached to the door proximate a rear edge of the door. This arrangement, utilizing the commonly employed pivotal hinge attached to the rear of the door, further simplifies the manufacture and installation of the motorized system while providing effective system operation.

According to a further feature of the invention, the spaced anchor points on the body structure comprise a first anchor point proximate the rear edge of the door opening and a second anchor point along the guide track rearwardly of the first point, and the cable assembly includes first and second runs extending from the drum and through the guide structure for connection to the first and second anchor points respectively. This arrangement provides a simple cable assembly and provides extremely effective pushing and pulling movement of the door to accomplish the opening and closing of the door.

According to a further feature of the invention, the guide structure defines separate first and second guide channels which cross in the guide structure and lie in first and second spaced planes to accommodate the crossing. This arrangement provides effective pushing and pulling action of the cable in a compact and efficient package.

According to a further feature of the invention, each run is anchored at one end thereof to the drum and the runs are wrapped around the drum in opposite directions. This arrangement provides a firm and positive pushing and pulling movement of the doors, without slippage.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
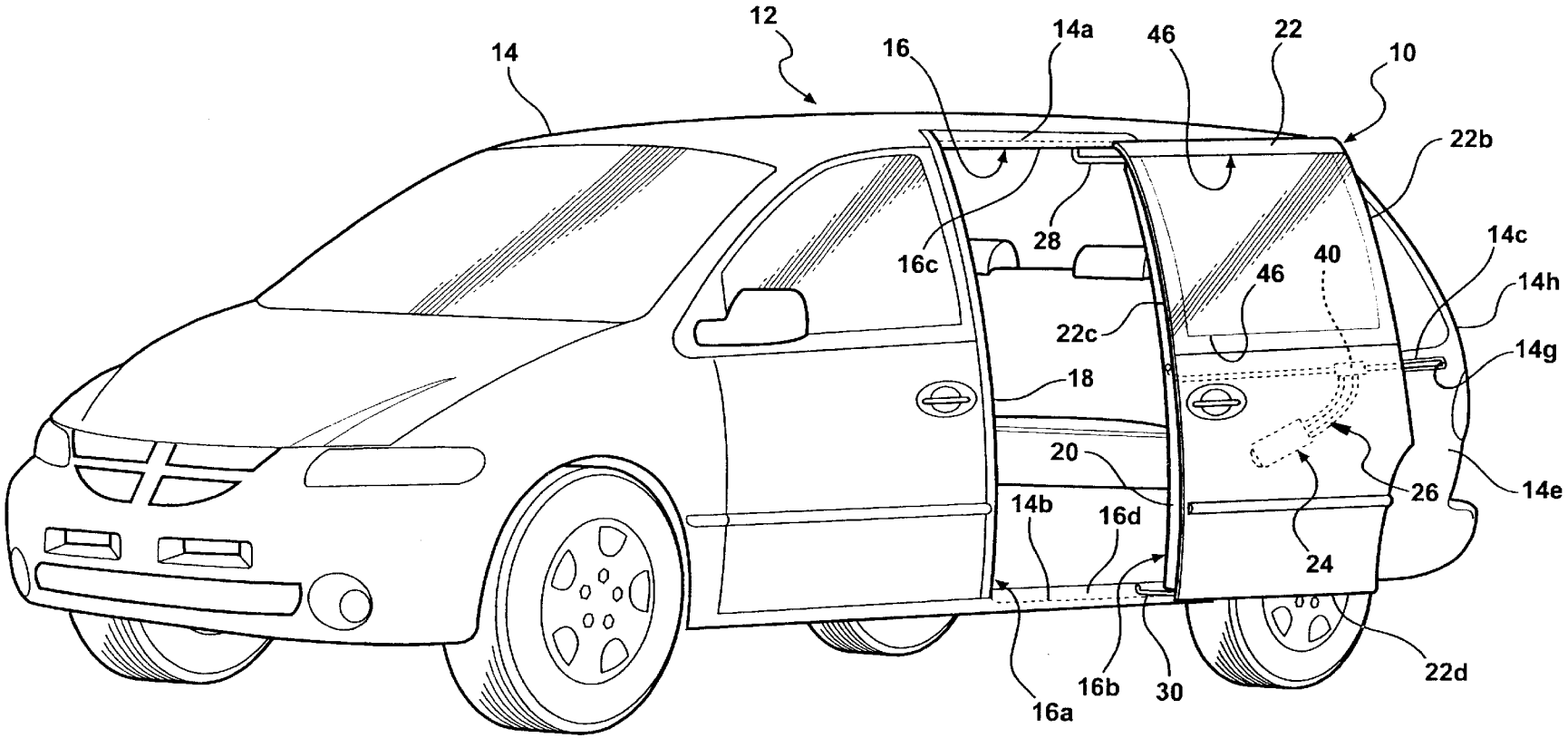
FIG. 1 is a perspective view of a van type motor vehicle utilizing a power sliding door assembly according to the invention.

The power sliding door assembly 10 of the invention is seen in FIG. 1 in association with a motor vehicle 12 including a body structure 14 defining a side door opening 16 having a front vertical edge 16*a* defined by the B-pillar 18 of the vehicle, and a rear vertical edge 16*b* defined by the C-pillar 20 of the vehicle.

Sliding door assembly 10, broadly considered, includes a sliding door 22, a motor assembly 24, and a cable assembly 26.

Sliding door 22 is mounted on the bod structure for sliding movement between a closed position (FIG. 6) positioned within the door opening and an open position (FIG. 5) removed from the door opening. The sliding movement of the door is guided by an upper front rigid hinge member 28 secured to the upper front corner of the door assembly and slidably guiding in a track 14*a* provided in the body structure along the upper edge 16*c* of the door opening, a lower front rigid hinge member 30 secured to the lower front corner of the door and slidably guiding in a track 14*b* provided in the body structure along the lower edge 16*d* of the door opening, and a central rear pivotal hinge member 32 (FIG. 9) pivotally mounted on a bracket 33 positioned on an inner face 22*a* of the door proximate the rear edge 22*b* of the door and including a roller 34 rollably guiding in a track 14*c* extending rearward in the rear quarter panel 14*e* of the body structure. The front end 14*f* of track 14*c* bends around C-pillar 20 and the rear end 4*g* of the track 14*c* is positioned proximate the rear 14*h* of the vehicle.

Figure 7:
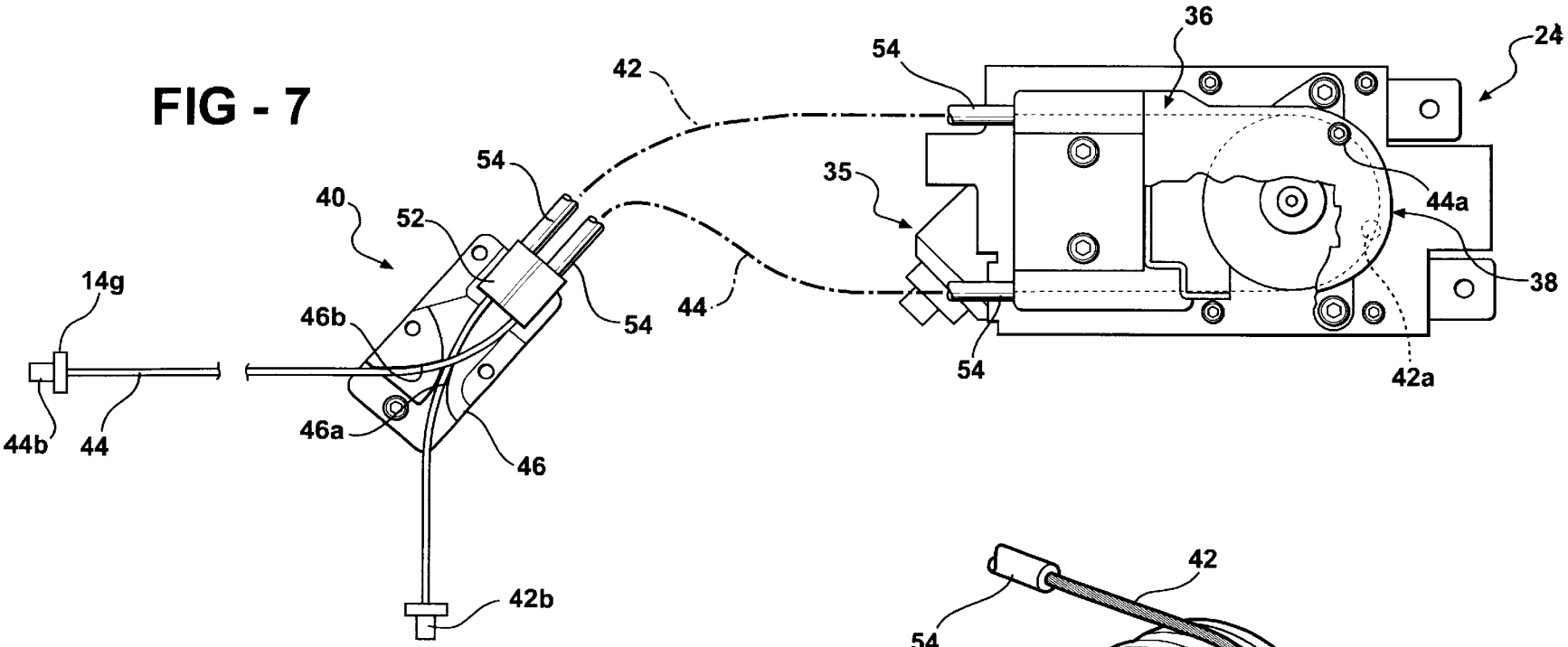
FIG. 7 is a somewhat schematic view of a motor and cable assembly utilized in the invention sliding door assembly.
Figure 8:
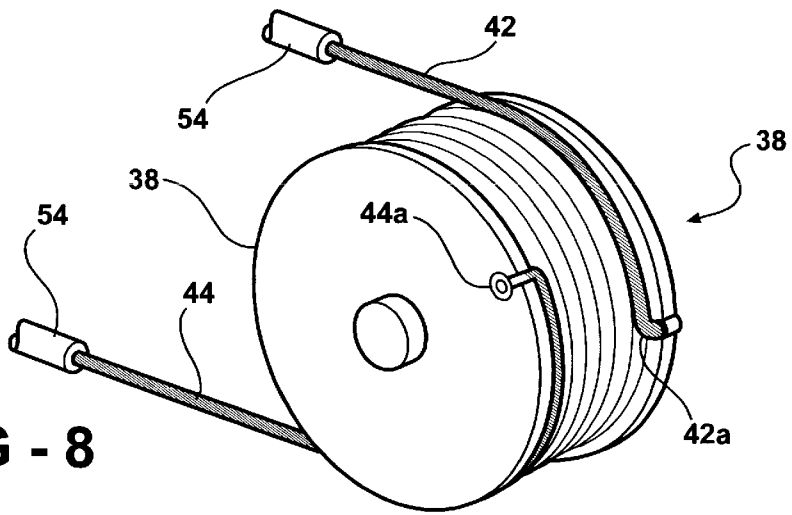
FIG. 8 is a perspective view of a drum forming a part of the motor assembly.

Motor assembly 24 (FIGS. 7 and 8) includes a reversible electric DC motor 35, a speed reducer 36 driven by the motor, and a drum 38 driven by the speed reducer. Motor assembly 24 is mounted on door 22 at a location (FIG. 2) essentially midway between the front edge 22*c* of the door and the rear edge 22*b* and at a location essentially midway between the lower edge 22*d* of the door and the lower edge 46*a* of the door window opening 46. It will be understood that the door assembly is mounted on the interior of the door and that, in the completed motor vehicle, an inner door panel conceals the motor assembly.

Cable assembly 26 (FIGS. 4, 7, 8, and 9) includes a guide block 40, a first cable run 42, and a second cable run 44.

Guide block 40 includes a base member 46 and a cover member 48. Cover member 48 fits over base member 46 and coats with base member 46 to define a first actuate cable groove 46a and a second actuate cable groove 46*b*. It will be seen that the grooves intersect one another and that the grooves are positioned on different planes. Base member 46 and cover 48 are fixedly positioned to hinge member 32 utilizing suitable fasteners 50. Base member 46 and cover 48 further coact to define a socket 46*c* for clamping receipt of a cable guide 52 which, with the cover secured to the base member, defines a pair of parallel cable guide channels 52*a* and 52*b* aligned respectively with grooves 46*a*, 46*b*.

First cable run 42 has a first end 42*a* fixedly secured to drum 38, winds around the drum, and is suitably routed to cable guide 52 where it passes through channel 52*a* and thereafter through groove 46*a* for connection at its second end 42*b* to the body structure 14 at a location on C-pillar 20 proximate the front end 14*f* of guide channel 14*c*.

Second cable run 44 is fixed at a first end 44*a* thereof to drum 38, winds around the drum in a direction opposite to the direction of winding of cable 42, is suitably routed through the interior of the door to channel 52*b* of guide 52, and thereafter passes through groove 46*b* and is routed along body structure groove 14*c* where its other end 44*b* is anchored to the body structure by an anchor member 14*g*. The portions of the cables 42 and 44 extending from the drum 38 to the guide 52 further include an outer sheath 54 to guide the cable through the interior of the door to the guide block 46 and to protect the cable.

Figure 2:
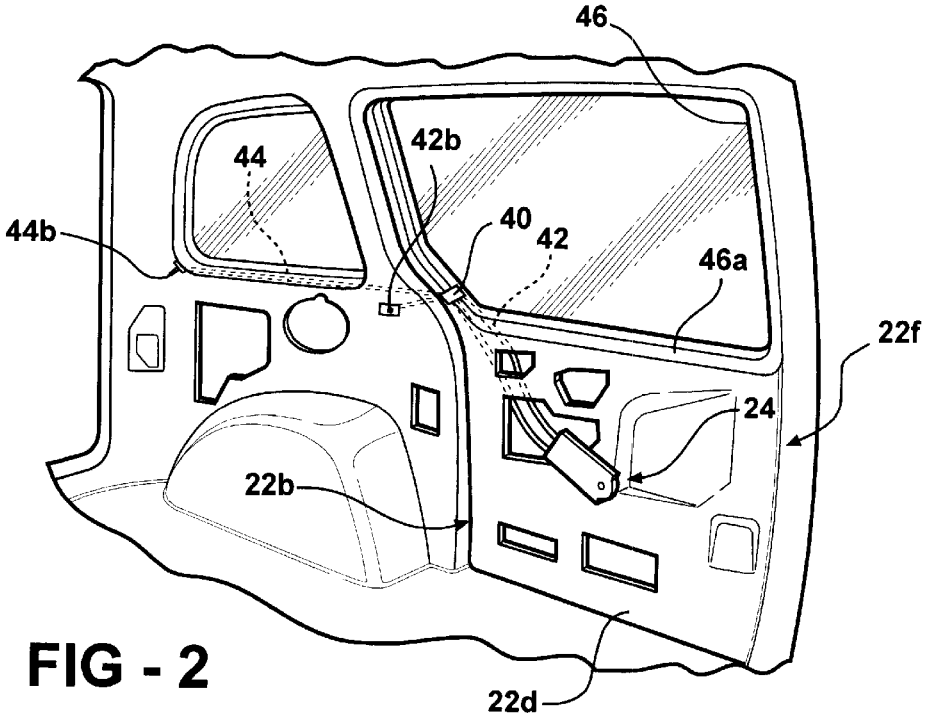
FIG. 2 is a fragmentary interior view of the vehicle of FIG. 1.
Figure 3:
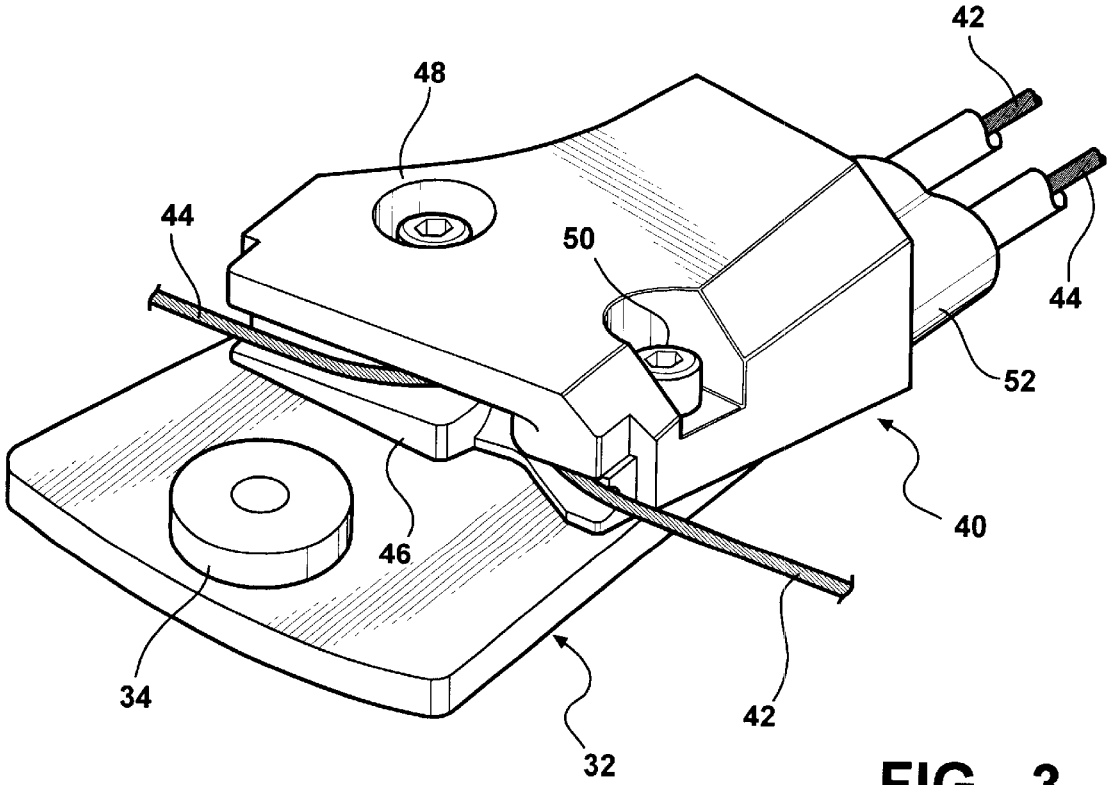
FIG. 3 is a perspective view of a cable guide structure employed in the invention sliding door assembly.
Figure 4:
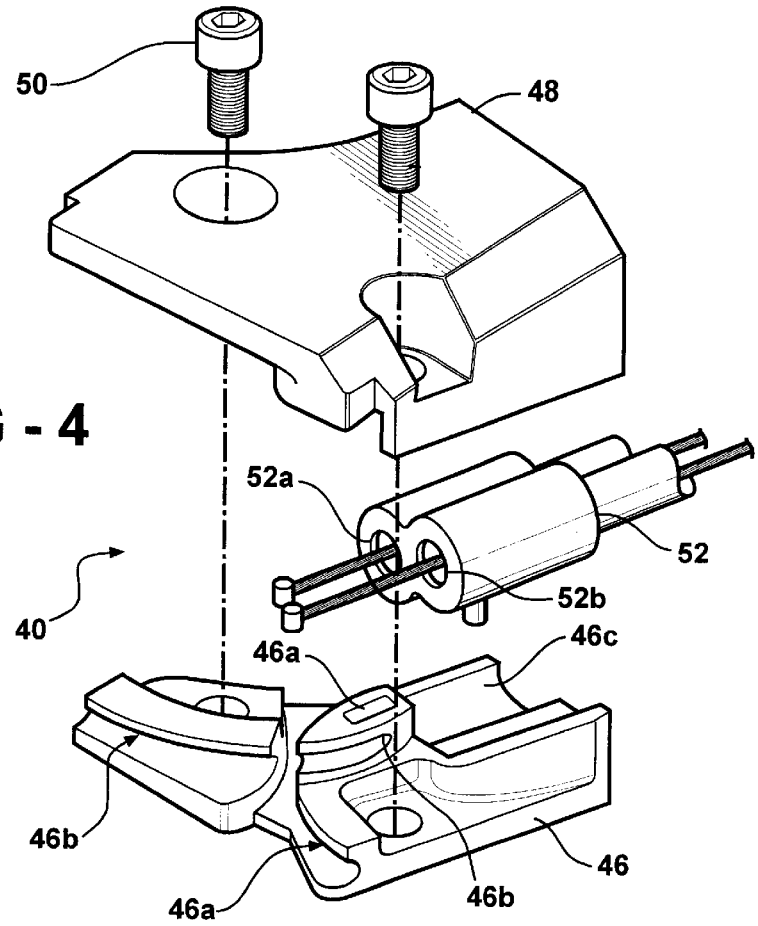
FIG. 4 is an exploded view of the cable guide structure of FIG. 3.
Figure 5:
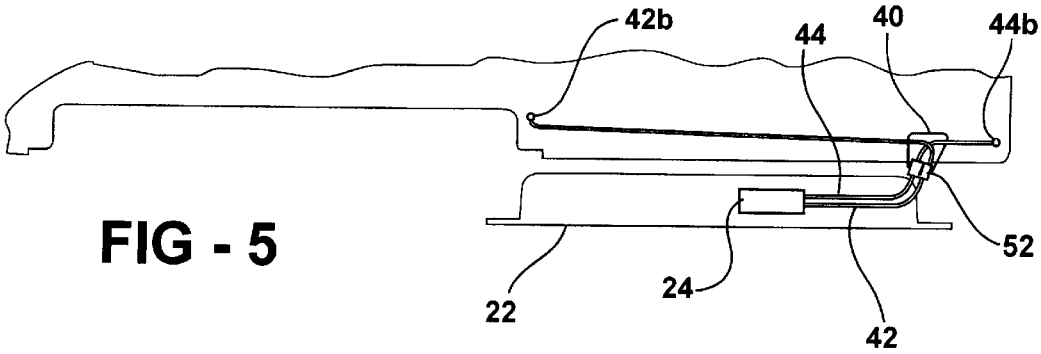
FIGS. 5 and 6 are schematic views illustrating the opening and closing movement of the sliding door.
Figure 6:
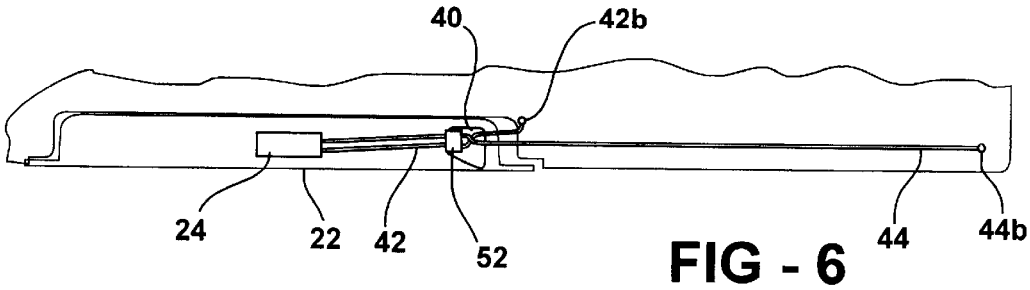
Figure 9:
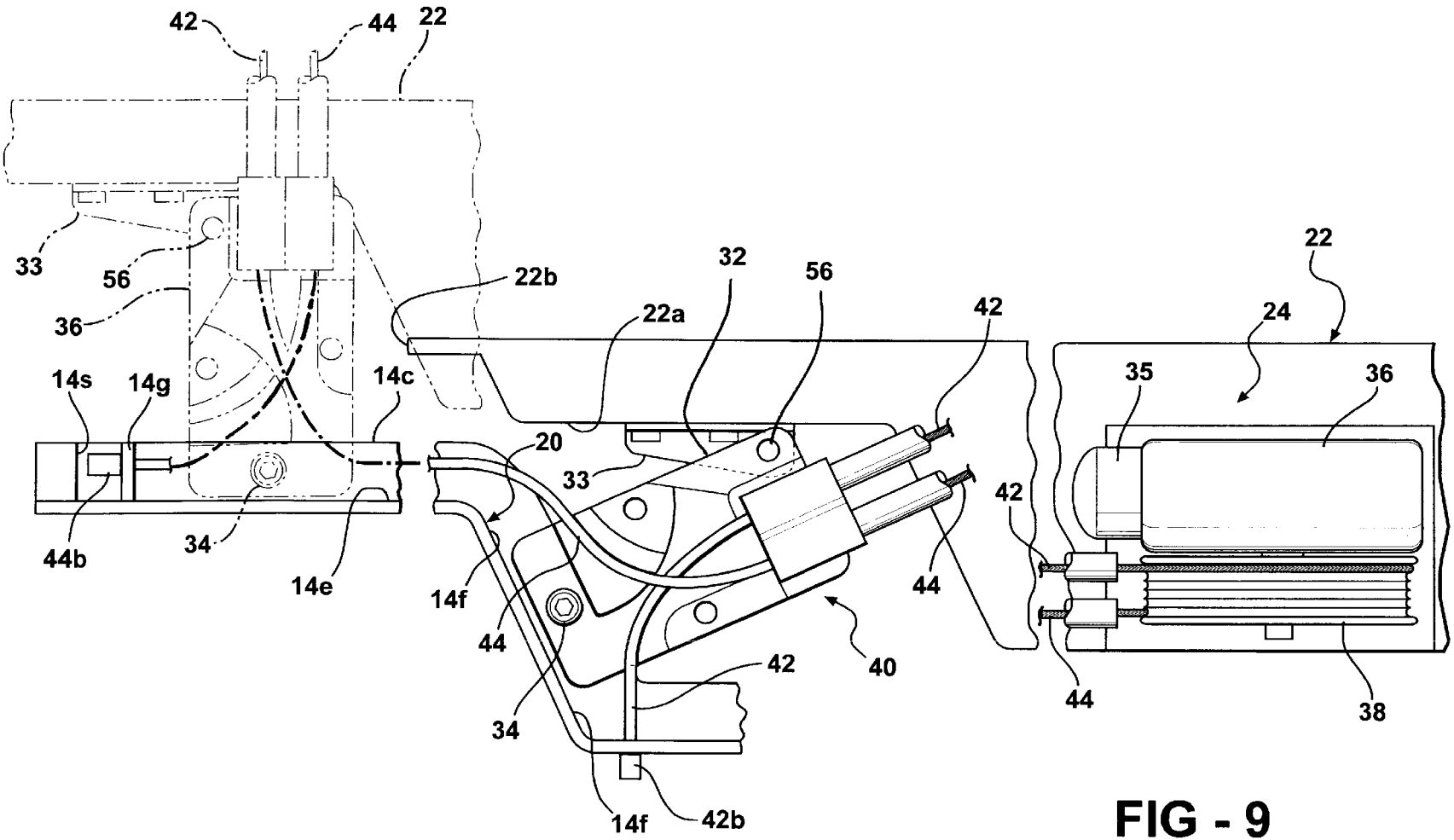
FIG. 9 is a view illustrating the movement of a rear door hinge member carrying the cable guide structure.

As the door moves slidably between the open position seen in FIGS. 1 and 5 and the closed position seen in FIGS. 2 and 6, the movement of the door is guided by upper front rigid hinge member 28 moving in track 16*c*, lower front rigid hinge member 30 moving in track 16*d*, and rear pivotal hinge member 32 moving in track 14*c*. As the door moves slidably forwardly from the open position to the closed position, motor 35 is energized in a direction to rotate spool 38 in a direction to take up cable 42 while paying out cable 44. This has the effect of (FIG. 9) pulling the door slidably forwardly and, specifically, the winding in of cable 42 pulls hinge member 32 and thereby door 22 forwardly along track 14*c* while cable 44 is simultaneously being paid out from the drum to allow the forward movement. As the hinge member 32 arrives at the forward end of the guide track 14*c*, it enters the end portion 14*f* of the guide track and undergoes a pivotal movement about its pivot pin 56 whereby to initiate the final closing movement of the door. The door and hinge member 32 are seen in FIG. 9 in dash line at the start of the forward, closing movement and in solid line after the hinge member 32 has undergone its pivotal movement about the pin 56 but just prior to the final closing movement of the door. It will be understood that, in known manner, a separate closer mechanism will normally be provided in the form of an electric motor or solenoid to effect the final closing and latching movement of the door.

In the opening movement of the door, the closer is actuated to unlatch the door and pop the door open where after motor 35 is energized in a sense to rotate 38 in a direction to wind in cable 44 while paying out cable 42. Cable 44 as it winds around the drum has the effect of pulling the door rearward along the track 14*c* while cable 42 is paid out by the drum to allow such rearward movement. The final rearward or open position of the door is seen in dash lines in FIG. 9.

The invention will be seen to provide many important advantages. Specifically, mounting the motor assembly on the door frees up the area proximate the interior area of the vehicle proximate the rear quarter panel of the vehicle for other accessory items such as speakers, safety apparatus, or the like. Further, the use of a cable assembly in combination with a motor assembly mounted on the door allows the motor assembly to be centrally located on the door whereby to affect a balancing of forces during the opening and closing movement of the door to avoid twisting and binding. The combined motor assembly/cable assembly mounted on the door has the further advantage of allowing the existing rear hinge pivot structure to be utilized to provide routing for the cables whereby to simplify the overall installation, minimize the cost of the overall installation, and place the critical elements of the power drive mechanism in a relatively sheltered environment.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A power sliding door mechanism for use with a motor vehicle having a body structure defining a door opening, a door, and a guide hinge pivotally attached to the door and slidingly engaged to the body structure in a guide track extending rearward along the body structure from a rear edge of the door opening for mounting the door in sliding engagement with the body structure for movement of the door between a closed position within the door opening and an open position removed from the door opening, the sliding door mechanism comprising:

an electric motor mounted on the door, a drum driven by the motor, a first and a second cable driven by the drum and adapted to be anchored to spaced points on the body structure, and a cable guide block attached to the door having a first cable groove on a first horizontal plane and a second cable groove on a second horizontal plane spaced vertically from and parallel to the first plane for receiving and guiding the first and the second cables and operative in response to energization of the motor to move the door between the open and closed positions.

2. A sliding door mechanism according to claim 1 wherin:

the spaced anchor points on the body structure comprise a first anchor point proximate a rear edge of the door opening and a second anchor point on the guide track rearwardly of the first point; and the first and second cables extend from the drum and through the first and the second cable grooves for connection to the first and second anchor points respectively.

3. A sliding door mechanism according to claim 1 wherein the first and second cable grooves cross in said guide block.

4. A sliding door mechanism according to claim 1 wherein:

each cable is anchored at one end thereof to the drum and the cables are wrapped around the drum in opposite directions.

5. The sliding door mechanism of claim 1 wherein the cable guide block is mounted to a guide hinge.

6. The sliding door mechanism of claim 5 wherein the guide block further comprises a cover mounted to a base, the cover and base defining the first and the second cable grooves and the first and the second spaced planes.

7. A power sliding door mechanism for use with a vehicle having a forward and a rearward end and a body structure having a door opening for receiving a door slidingly engaged with the body structure, the door further having a guide hinge slidingly engaged in a guide track mounted to the body structure extending rearward from the door opening, the sliding door mechanism comprising:

an electric motor attached to the door, a drum rotatably engaged to the motor, a cable guide block attached to the guide hinge having a first cable groove therethrough in a first horizontal plane and a second cable groove therethrough in a second horizontal plane spaced vertically from and parallel to the first plane;

a first cable section positioned along a first cable run passing through the first cable groove and having a first end attached to the drum and a second end attached to a first anchor point on the body structure, and a second cable section positioned along a second cable run passing through the second cable groove having a first end attached to the drum and a second end attached to a second anchor point on the body structure rearward of the first anchor point, the sliding door mechanism operable to wind the first and second cable sections around the drum to move the door between a closed position in the door opening and an open position away from the door opening.

8. The sliding door mechanism of claim 7 wherein the first and the second cable sections wrap around the drum in opposite directions.

9. The sliding door mechanism of claim 7 wherein the first and second cable grooves cross directions in the cable guide block.

10. The sliding door mechanism of claim 7 wherein the cable guide block further comprises a base attached to the guide hinge and a cover attached to the base, the cover and the base defining the first and the second cable grooves.

11. The sliding door mechanism of claim 7 wherein the first anchor point is proximate to a rear of the door opening and the second anchor point is proximate to a rear of the guide track.

12. A sliding door mechanism for use in a vehicle having a forward and rearward end, the vehicle including a body structure having a door opening, a door slidingly engaged to the body structure and having a guide hinge slidingly engaged in a guide track attached to the body structure, the sliding door mechanism comprising:

an electric motor attached to the door;

a drum rotatably engaged with the motor;

a cable guide block mounted to the guide hinge, the guide block having a base attached to the guide hinge and a cover attached to the base, the cover and the base defining a first cable groove therethrough in a first horizontal plane and a second cable groove therethrough in a second horizontal plane spaced vertically from and parallel to the first plane, the first and the second cable grooves crossing in the guide block;

a first cable section positioned along a first cable run, said first cable section having a first end attached to the drum and passing through the first cable groove, and a second end attached to the body structure at a first anchor point proximate to a rear edge of the door opening, and a second cable section positioned along a second cable run, said second cable section having a first end attached to the drum and passing through the second cable groove, and a second end attached to the body structure at a second anchor point proximate to a rear, portion of the guide track, the first and the second cable sections adapted to wind around the drum in opposite directions upon rotation of the drum, the sliding door mechanism operable to move the door between a closed position in the door opening and an open position away from the door opening.

13. A sliding door cable mechanism for use in a vehicle including a body structure having a door opening and including a guide hinge mounting a sliding door to the body structure for sliding movement of the door between a forward closed position and a rearward open position, the guide hinge mounted on the door and slidingly engaging a guide track mounted on the body structure and extending rearward from the door opening, the sliding door mechanism including an electric motor mounted to the door of the vehicle and having a drum rotatably engaged to the motor, a cable guide structure mounted to the guide hinge, a cable engaged with the drum and routed along a first and a second run through the cable guide structure, the cable attached to the body structure at a first anchor point proximate to a rear edge of the door opening, and at a second anchor point rearward of the first anchor point, the cable guide structure comprising:

a guide block having a base mounted to the guide hinge and a cover attached to the base, the cover and the base defining a first cable groove therethrough in a first horizontal plane and a second cable groove therethrough in a second horizontal plane spaced vertically from and parallel to the first plane, the first and the second cable grooves crossing in the guide block, a first section of said cable having a first end attached to the drum and passing through the first cable groove and attached at the first anchor point, and a second section of said cable having a first end attached to the drum and passing through the second cable groove and attached at the second anchor point, the first ends of the first and second cable sections attached to the drum such that the first and second cable sections wrap around the drum in opposite directions upon rotation of the drum to move the door between a closed position in the door opening and an open position away from the door opening.

14. A power sliding door mechanism for use with a vehicle having a forward and a rearward end and a body structure having a door opening receiving a door slidingly engaged with the body structure, the door further having a guide hinge slidingly engaged in a guide track mounted to the body structure extending rearward from the door opening, the sliding door mechanism comprising:

an electric motor attached to the door, a drum rotatably engaged to the motor, a cable guide block attached to the guide hinge and having a first cable groove therethrough in a first horizontal plane and a second cable groove therethrough and a second horizontal plane spaced vertically from and parallel to the first plane;

a first cable section positioned along a first cable run passing through the first cable groove and having a first end attached to the drum and a second end attached to a first anchor point on the body structure, a second cable section positioned along a second cable run passing through the second cable groove and having a first end attached to the drum and a second end attached to a second anchor point on the body structure rearward of the first anchor point, the sliding door mechanism operable to wind the first and second cable sections around the drum to move the door between a closed position in the door opening and an open position away from the door opening;

the cable guide block further comprising a base attached to the guide hinge and a cover attached to the base, the cover and the base defining the first and second cable grooves; and the cable guide block further comprising a cable guide receivable in a socket in the guide block to guide the first and the second cable sections through the guide block.

* * * * *